US005864269A

United States Patent [19]

Grueber et al.

[11] Patent Number: 5,864,269

[45] Date of Patent: Jan. 26, 1999

[54] ELECTROMAGNETIC HINGED-ARMATURE RELAY

[75] Inventors: Andreas Grueber, Erwitte; Wolfgang Hoffmann, Lippstadt; Andre Koerner, Lippstadt; Maik Zimmer, Lippstadt, all of Germany

[73] Assignee: Hella KG Hueck & Co., Lippstadt, Germany

[21] Appl. No.: 754,330

[22] Filed: Nov. 21, 1996

[30] Foreign Application Priority Data

Nov. 30, 1995 [DE] Germany ..... 195 44 624.0

[51] Int. Cl.[6] ..... H01H 51/22

[52] U.S. Cl. ..... 335/78; 335/80; 335/125; 335/130; 335/131; 335/83; 335/86; 335/187; 335/196

[58] Field of Search ..... 335/78–86, 128, 335/130, 131, 187, 196, 202

[56] References Cited

U.S. PATENT DOCUMENTS

| | | | |
|---|---|---|---|
| 2,178,151 | 10/1939 | Wagar | 200/166 |
| 4,296,393 | 10/1981 | Sauer et al. | 335/125 |
| 4,517,537 | 5/1985 | Weiser et al. | 335/187 |
| 4,910,484 | 3/1990 | Shikano et al. | 335/61 |
| 4,937,544 | 6/1990 | Mueller | 335/128 |
| 5,392,015 | 2/1995 | Matsuoka et al. | 335/78 |
| 5,534,834 | 7/1996 | Hendel | 335/78 |
| 5,719,541 | 2/1998 | Mader | 335/78 |

FOREIGN PATENT DOCUMENTS

| | | |
|---|---|---|
| 0281 384 B1 | 9/1988 | European Pat. Off. . |
| 0 666 580 A1 | 8/1995 | European Pat. Off. . |
| 26 02 362 | 8/1976 | Germany . |

*Primary Examiner*—Michael L. Gellner
*Assistant Examiner*—Tuyen T. Nguyen
*Attorney, Agent, or Firm*—Griffin, Butler, Whisenhunt & Szipl, LLP

[57] ABSTRACT

An electromagnetic hinged-armature relay comprises a contact spring (2) which is arranged on and attached to an armature (1). The contact spring serves as a switching contact spring and has a bounce dampener which is in the form of a swing element (3) made as one piece with the contact spring which greatly reduces bounces of contacts and contact wear resulting therefrom.

4 Claims, 1 Drawing Sheet

ELECTROMAGNETIC HINGED-ARMATURE RELAY

BACKGROUND OF THE INVENTION

This invention concerns an electromagnetic hinged-armature relay having a contact spring with a bounce retarder attached to an armature for reducing contact bounces.

Hinged-armature relays, for example for use in motor vehicles, typically bounce from one to four times upon closing of normally-open make contacts and three to ten times upon closing of normally-closed break contacts, whereby for each bounce, depending upon a load being switched, strong arcs are sometimes ignited which cause high contact wear, which, in turn, negatively affect the life of such a relay.

European Patent EP 0 281 384 B1 discloses an electromagnetic hinged-armature relay which has a miniature air cylinder dampener as a bounce dampener which, depending upon requirements, is provided to reduce noise production of the electromagnetic relay.

Aside from the facts that such a solution is quite expensive and, because electromagnetic hinged-armature relays are manufactured in such volume, represent a large costs factor, it is also questionable if such an arrangement sufficiently protects contacts against consumption by burning.

German Patent DE 26 02 362 A1 discloses an arrangement for suppressing bounces of a closing armature of flat relays, in which, a device is provided at an area of a free end of the relay for absorbing movement energy of the armature after its impact on the relay core.

One or more additional masses can be provided on the armature of the relay to serve as such a device.

Aside from the fact that the solution suggested here is also structurally quite expensive, a transfer of this solution from a flat relay, as disclosed, to a small-structured hinged armature relay is not possible without further changes because the mounting space to attach such an additional device is generally not available, at least not without a disadvantageous enlargement of the structural volume of the hinged-armature relay.

It is therefore, an object of this invention to provide an uncomplicatedly-constructed and cost effective hinged-armature relay in which contact bounce is substantially prevented by structural measures which are particularly uncomplicated.

SUMMARY OF THE INVENTION

According to principles of this invention, a bounce dampener is constructed as one piece with a contact spring as a swing element.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
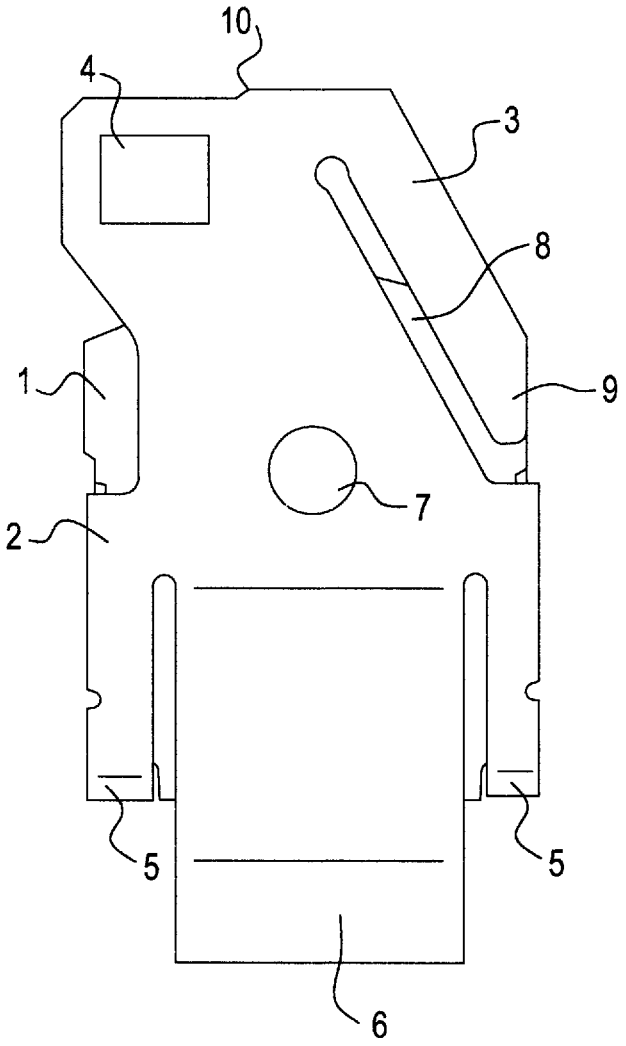
FIG. 1 is a plan view of an embodiment of a contact spring of this invention attached to an armature of a hinged-armature relay.

The single drawing shows an arrangement of a contact spring attached to an armature. Various other features of the hinged-armature relay are not shown on this drawing, because they are not necessary to an explanation of the invention.

The contact spring 2 has one or more switch contacts 4. Two end portions 5 of the contact spring extend about an end edge of an armature 1. A further end portion 6 of the contact spring 2 is bent to be perpendicular to the plane of the drawing and forms a return spring as one piece with the contact spring 2 for the armature 1. The contact spring is attached approximately in the middle of the armature 1 by means of a rivet attachment 7.

According to this invention, the contact spring 2 forms a swing element 3 which is formed on the contact spring 2 as one piece therewith by a cut-out, or recess, 8 which is made in the contact spring 2.

This swing element 3 extends from the contact spring edge 10 outwardly to be free to swing, relative to the armature 1, which it touches, or at least covers, with its free end portion 9 (that is, the end which is not attached to the contact spring).

When the normally-open make contacts (not shown) close, because of a deflection of the contact spring 2 and an inclination of its end 10 resulting therefrom, the swing element 3 which is formed at this end, is biased against the armature and carries out a movement relative to the armature 1. In this manner, the bounce energy of the contact is changed into a friction energy, whereby the bouncing, at least for suitably dimensioned swing elements 3, is completely eliminated. Thus, the swing element 3 is a bounce retarder.

Upon closing of a normally-closed break contacts (from which only the moveable contact 4 is shown in the drawing) the free end portion 9 of the swing element 3 swings over, during which a large portion of the swing, or bounce, energy of the spring contact is transmitted to the swing element 3.

When the swing element 3 swings back, it contacts the armature, which by this time is at rest, and bows, whereby a movement of the free end portion 9 of the swing element 3 relative to the armature 1 is created which converts the swing energy into friction energy to thereby significantly reduce contact bounce.

This, structurally-speaking, particularly uncomplicated inventive solution has the benefit that contact bounce is at least substantially reduced without the relay requiring additional individual parts, particularly no additional masses requiring increased structural volumes because this bounce dampener is constructed as one piece as a part of the contact spring. The swing element which acts as a bounce dampener can, in a beneficial manner, be formed in a particularly simple manner by placing the cut-out or slot, in the contact spring. Thus, this inventive solution can be carried out in a particularly uncomplicated and cost effective manner.

A particularly beneficial embodiment of a hinged-armature relay of this invention having the bounce dampener is produced by having the swing element extend outwardly from the area of the contact spring at the contacts, so as to be capable of swinging toward the armature, which it touches, or at least covers, with the end not attached to the contact spring. In this manner, a mechanical movement energy which otherwise would lead to contact bounce, is not only converted to a swing energy of the swing element, but also is particularly effectively absorbed by the end portion of the swing element contacting, or rubbing on, the armature so that is it is converted to heat energy.

While the invention has been particularly shown and described with reference to a preferred embodiment, it will be understood by those of ordinary skill in the art that various changes in form and detail may be made therein without departing from the spirit and scope of the invention.

The invention claimed is:

1. Electromagnetic hinged-armature relay including a contact spring having a main portion rigidly attached to an armature to be movable therewith, an electrical contact area of said contact-spring being on said main portion of said contact spring, the contact-spring having a bounce retarder to reduce contact bounce, wherein the bounce retarder is constructed as one piece with the contact spring as a swing element, said swing element having an attached end at which it is attached to said main portion of said contact spring and a free portion having freedom of movement to swing relative to the main portion of said contact spring, wherein the free portion of the swing element extends outwardly away from the main portion of the contact spring to be capable of swinging toward the armature which it touches.

2. Electromagnetic hinged-armature relay as in claim 1 wherein the swing element is defined by a cut-out in the contact spring.

3. Electromagnetic hinged-armature relay as in claim 1 wherein the free portion of the swing element extends outwardly from the contact area of the contact spring to be capable of swinging toward the armature which it covers with an end portion.

4. Electromagnetic hinged-armature relay as in claim 1 wherein said free portion extends adjacent the main portion separated therefrom by a cut-out.

* * * * *